US005961400A

United States Patent [19]

Broom

[11] Patent Number: 5,961,400

[45] Date of Patent: Oct. 5, 1999

[54] PUTTER

[76] Inventor: Richard Patrick Broom, 5227 Crystal Springs Dr., Bainbridge Island, Wash. 98110

[21] Appl. No.: 09/108,903

[22] Filed: Jul. 1, 1998

Related U.S. Application Data

[63] Continuation-in-part of application No. 29/087,553, May 5, 1998.

[51] Int. Cl.[6] ..... A63B 53/04

[52] U.S. Cl. ..... 473/340; 473/313; 473/341

[58] Field of Search ..... 473/313, 314, 473/340, 341, 325, 251, 252, 253, 255; D21/733, 736, 740, 741; 403/268

[56] References Cited

U.S. PATENT DOCUMENTS

D. 387,829 12/1997 Blaine .
3,042,405 7/1962 Solheim .
4,984,794 1/1991 Pernelle et al. ..... 473/313
5,014,992 5/1991 McCallister ..... 473/314
5,078,398 1/1992 Reed et al. ..... 473/341 X
5,226,654 7/1993 Solheim .
5,267,733 12/1993 Szokola ..... 473/341
5,494,288 2/1996 Jimenez et al. ..... 473/341 X

*Primary Examiner*—Kien T. Nguyen
*Attorney, Agent, or Firm*—Leonard Tachner

[57] ABSTRACT

A putter (10) including a putter head (12) attached to a golf shaft (14) having a longitudinal axis (16). The putter head (12) includes a heel (18) and toe (20). A sole (22) extends along the bottom of the putter head (12). A putter face (24) is provided for impacting a golf ball (66). A cantilevered extension (26) is provided between the putter head (12) and a hosel (28) for the putter (10). The cantilevered extension (26) includes a lower flange (30) that faces the upper side of the toe (20) of the putter head (12).

18 Claims, 3 Drawing Sheets

PUTTER

REFERENCE TO RELATED APPLICATIONS

This application is a continuation-in-part of U.S. Design patent application Ser. No. 29/087,553, filed May 5, 1998 still pending.

FIELD OF THE INVENTION

This invention relates generally to golf clubs, and more particularly to a putter structure having an improved, balanced design.

BACKGROUND OF THE INVENTION

As is well-known by everyone who plays golf, putting has plagued all types of players, and the quest for improved putters and putting techniques never ends. Even the most talented tour players strive to improve techniques, or to find a new putter that will improve performance or give a technology advantage over competitors.

With regard to the structure of putters, as recently as about 40 years ago, engineering principles were applied to the design of putters for the first time, and a design which became known as "heel-toe balanced" was devised. Prior to this innovation, putters were for the most part essentially flat, plate-like structures commonly referred to as "blade" putters.

A putter design in accordance with the "heel-toe balanced" principle has its mass concentrated in the heel and toe of the putter head. This provides an increased moment of inertia that causes the putter head to resist twisting when a golf ball is struck at a point on the putter face which is away from the "sweet spot" of the putter. Such a putter is disclosed in U.S. Pat. No. 3,042,405 to Solheim.

In addition to having heel-toe balance, the putter disclosed in U.S. Pat. No. 3,042,405 has another design feature which is commonly referred to as "face balance". A face balanced putter is one having equal moment arms, i.e., the concentrated masses at the heel and toe are equally distant from the longitudinal axis of the golf shaft, or the axis rotation of the golf shaft. Face balancing is accomplished in U.S. Pat. No. 3,042,405 by connecting the shaft of the putter centrally between the toe and the heel of the putter so that it is located proximate to the center of gravity of the putter head.

U.S. Pat. No. 5,226,654, also to Solheim, discloses a putter with concentrations of mass in the toe and heel portions. The putter head is configured so that its center of gravity is approximately midway between the toe and heel of the putter. Stability is maintained by an especially configured hosel which extends vertically from proximate the heel of the putter head and positions the putter shaft so that the longitudinal axis of the putter shaft intersects an imaginary line at a point forward of the face of the putter, with the imaginary line being normal to the face of the putter and passing through the center of gravity of the putter.

Although each of the Solheim designs described above solves many of the problems regarding twisting of a putter head when the golf ball is struck at a point on the putter face which is away from the sweet spot of the putter, the putter heads do not provide a solution to many of the psychological problems golfers have with putting. Many golfers, including advanced golfers at competitive levels, experience a syndrome called the "yips". A golfer experiencing yips finds it difficult to strike a ball consistently and perform a mechanically correct putting swing.

In addition to the psychological aspects of a putting game, many golfers experience difficulty in properly aligning putts. Improper putting alignment can result from improper stance, grip, or ball positioning in the stance. Prior art designs of putters do not adequately aid a golfer in properly addressing a ball so that a correct swing of the putter can be made.

Therefore, a need exists for a new and useful putter which overcomes some of the shortcomings and disadvantages of the prior art.

SUMMARY OF THE INVENTION

The present invention provides a golf club including a putter head having a face, a toe and a heel. The golf club having an elongated shaft having a longitudinal axis and a lower end and a hosel attaching the putter head to the elongate shaft. The hosel and the putter head are arranged such that a portion of the hosel extends between the line of sight of a golfer using the golf club and a golf ball that is in a position against a portion of the face of the putter head, the portion of the face being substantially located at the center of gravity of the putter.

In one embodiment a cantilevered extension extends between the heel of the putter head and the hosel. The cantilevered extension preferably extends upward and forward from the heel toward the toe of the putter head so as to extend over the putter head. The cantilevered extension extends beyond a vertical projection of the center of the face of the putter head.

In accordance with one aspect of the invention, the putter head includes a toe mass concentration and a heel mass concentration. A third mass concentration can be provided that is located at the distal end of the cantilevered extension.

In accordance with another aspect of the invention, a projection of the longitudinal axis of the shaft coincides with the ball when the ball is against the face of the putter.

In accordance with yet another aspect of the invention, the golf club is balanced in weight relative to a projection of the longitudinal axis of the shaft. Preferably, the putter head is also balanced in weight on opposite sides of a vertical projection extending upward from the center of gravity of the putter.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
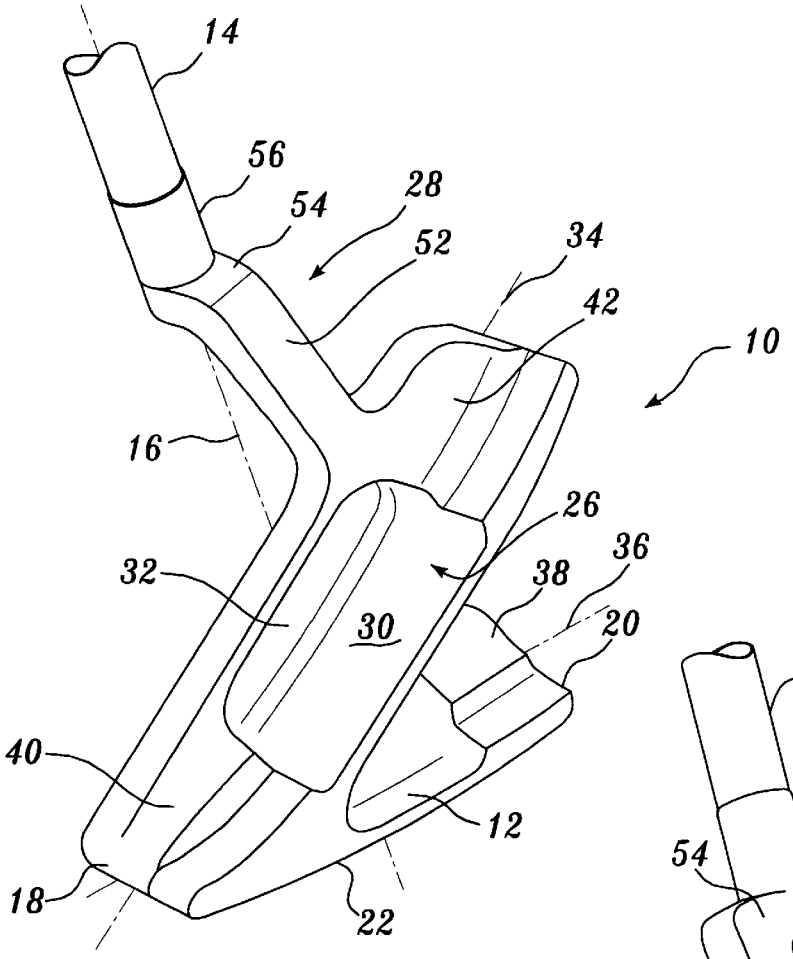
FIG. 1 is a rear, heel side perspective view of a putter embodying the present invention.
Figure 6:
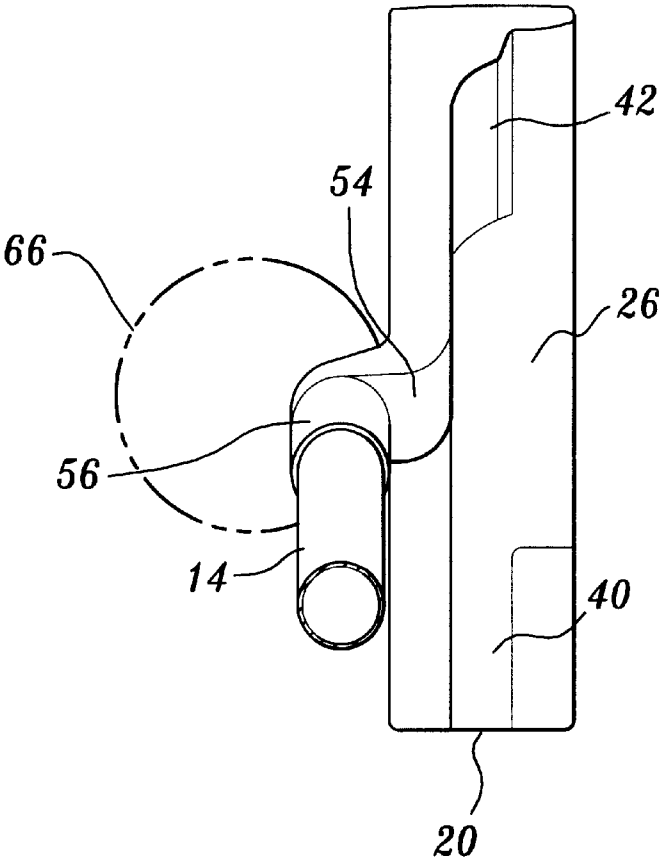
FIG. 6 is top perspective view of the putter of FIG. 5, taken at an angle from the heel side of the putter such as a golfer would view the putter when the shaft of a putter is gripped in the hands of the golfer.

Referring now to the drawing, in which like reference numerals represent like parts throughout the several views, FIG. 1 shows a putter 10 embodying the present invention. The putter 10 includes a putter head 12 attached to a golf shaft 14 having a longitudinal axis 16. The putter head 12 includes a heel 18 and toe 20. A sole 22 extends along the bottom of the putter head 12. A putter face 24 (FIG. 4) is provided for impacting a golf ball 66 (FIG. 6).

In accordance with the present invention, a cantilevered extension 26 is provided between the putter head 12 and a hosel 28 for the putter 10. The cantilevered extension 26 includes a lower flange 30 that faces the upper side of the toe 20 of the putter head 12. The cantilevered extension 26 also includes a front face 32 (best shown in FIG. 4) that extends perpendicular to the flange 30 and substantially coplanar with the face 24 of the putter head.

The cantilevered extension 26 has a longitudinal axis 34. Likewise, the putter head 12 has a longitudinal axis 36. The angle formed by the longitudinal axis 34 of the cantilevered extension 26 and the longitudinal axis 36 of the putter head 12 is preferably approximately 45 degrees but a variety of appropriate angles can be used to meet the requirements of the present invention.

The hosel 28 extends between a location adjacent the distal end of the cantilevered extension 26 and the lower end of the putter shaft 14.

Figure 2:
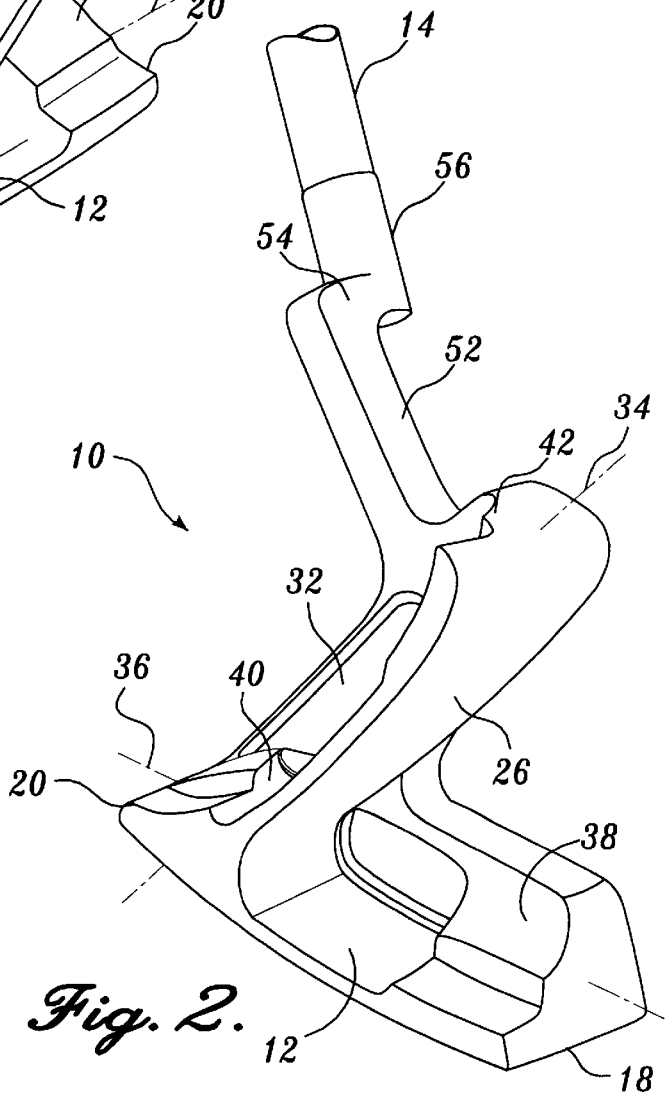
FIG. 2 is a rear, toe side perspective view of the putter of FIG. 1.
Figure 5:
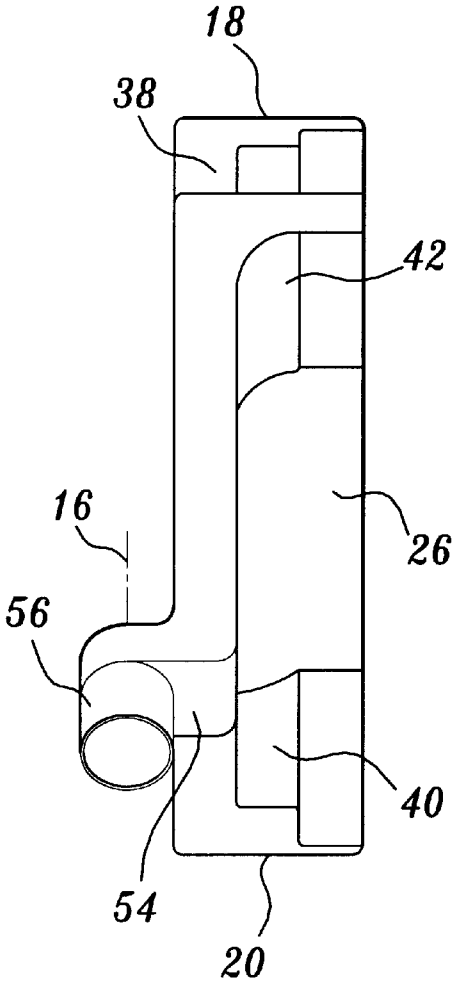
FIG. 5 is a top view of the putter of FIG. 1.

The hosel 28 includes a vertical leg portion 52 which extends approximately perpendicular to the longitudinal axis 34 of the cantilevered extension 26 from a point adjacent to the distal end of the cantilevered extension. The vertical leg portion 52 is bent over at its upper end to provide a cantilever arm 54 (best shown in FIGS. 2 and 5) which extends forwardly of the cantilevered extension 26 and the putter head 12. A socket-like boss 56 is formed on the extending end of the cantilever arm 54, and the lower end of the putter shaft 14 is fixed in the socket-like boss 56 in a manner known in the art.

The shaft 14 is preferably straight and includes the usual grip (not shown) mounted on its upper end. The shaft 14 can be made of metal, graphite, or any other suitable material.

The putter 10 can be formed of aluminum, steel, copper-beryllium, nickel, bronze, space-aged composites, plastic, or any other suitable material. If desired, the putter 10 can include a face insert (not shown) made of a suitable material such as a polymer or brass. Preferably, the putter 10 is cast or formed so that the putter head 12, the cantilevered extension 26, and the hosel 28 are one integral piece.

A toe mass concentration 38 is provided at the toe 20 of the putter head 12. A heel mass concentration 40 is provided at the intersection of the putter head 12 and the cantilevered extension 26. The heel mass concentration 40 is located above the flange 30. A third mass concentration 42 is located at the distal end of the cantilevered extension 26. The mass concentrations 38, 40, 42, and the remaining mass of the putter 10 is preferably arranged such that the putter is heel-toe balanced. More specifically, the mass concentrations 38, 40, 42 are located at some distances toe-ward and heel-ward from the center of gravity (located along the line 60 in FIGS. 3 and 4) for the putter head 12. Thus, the putter 10 of the present invention is provided with improved stability resulting from heel-toe balancing.

Figure 4:
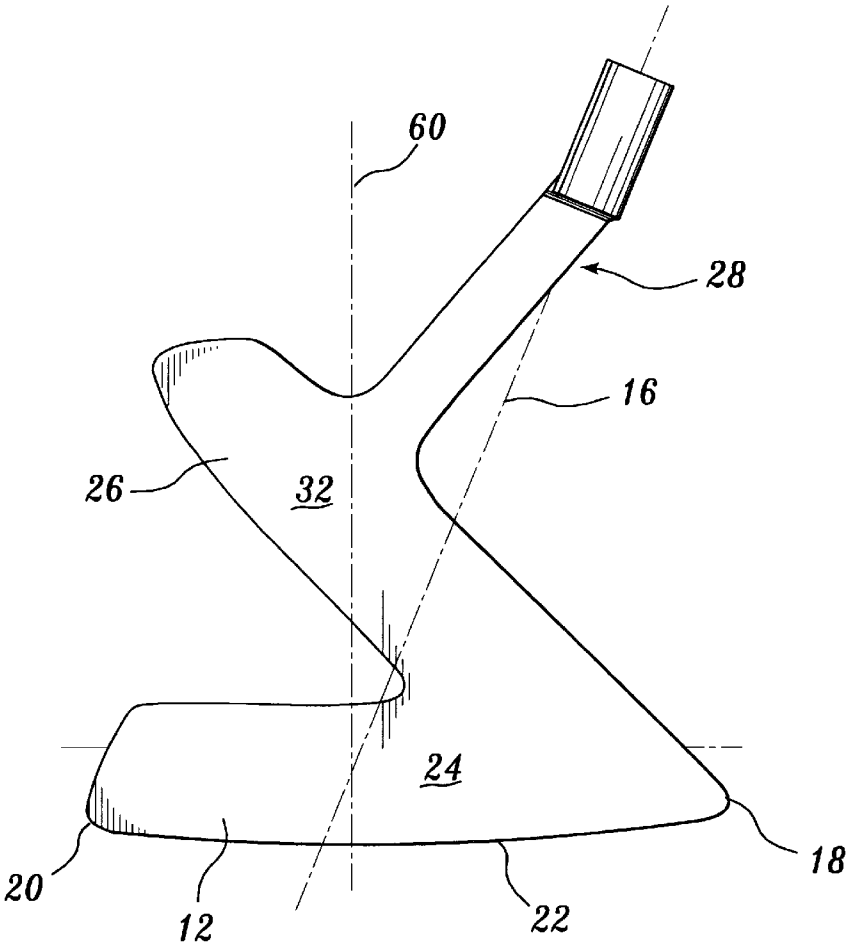
FIG. 4 is a front side view of the putter of FIG. 1.
Figure 3:
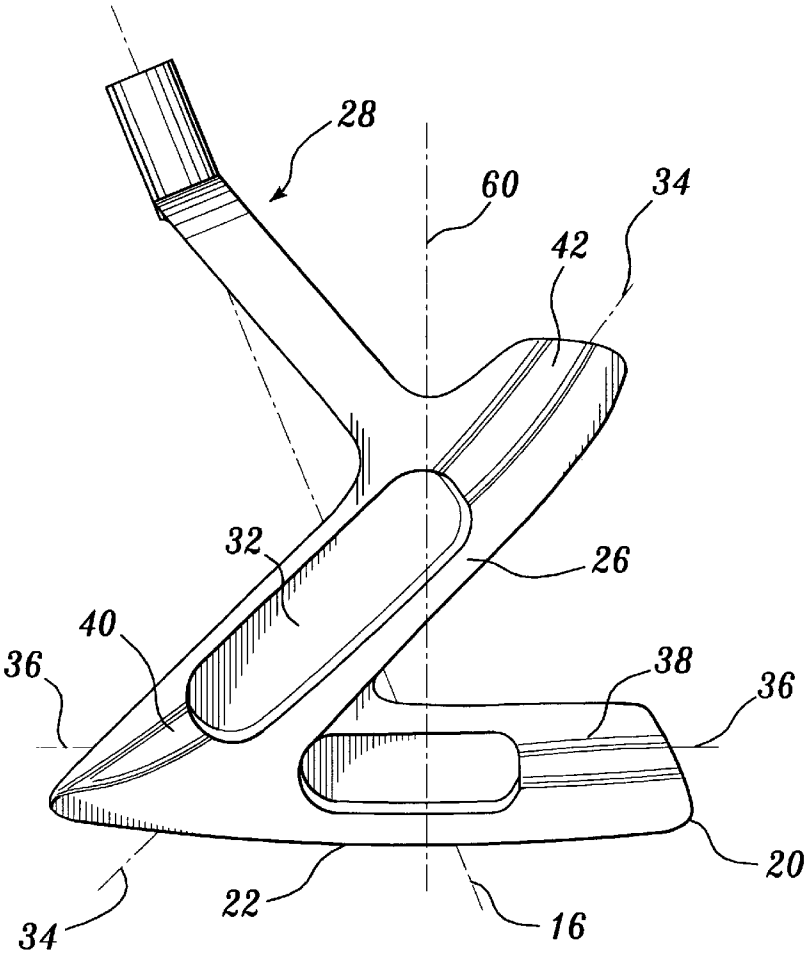
FIG. 3 is a rear side view of the putter of FIG. 1.

The putter 10 is also weight-balanced from heel to toe. That is, the putter 10 has equal moment arms at the heel and toe of the club that are equally distant from the center of gravity of the putter 10. As can be seen in FIGS. 3 and 4, this means that an equal amount of weight of the putter 10 is located on opposite sides of the line 60 extending upward through the center of gravity of the putter head 12.

In addition to being heel-to-toe balanced and weight-balanced, the utter 10 is face-balanced through a projection of the longitudinal axis 16 of the shaft 14. That is, an equal amount of weight of the putter 10 is located on opposite sides of a line projection of the longitudinal axis 16 of the golf shaft 14 (see FIGS. 3 and 4).

As can be seen in FIG. 6, when gripped by golfer in preparation for a putt, the putter head 10 is arranged such that the hosel 28 is located between the eyes of the golfer and a golf ball 66 located adjacent to the face 24 of the putter head 12. The golf ball 66 is preferably aligned against the center of gravity for the putter 10. With the golf ball 66 in this position, the cantilever arm 54 of the hosel 28 extends outward and is aligned between the eyes of the user and the golf ball 66. This arrangement obscures the moment of impact of the golf ball 66 and the club face 24 from the sight of the user. By not permitting the user to see contact of the putter face 24 with the golf ball 66, the user's apprehension of striking the golf ball is effectively eliminated.

It is believed that the optic nerve reacts when a putter face contacts a golf ball. Very often, this optic nerve reaction causes a player to decelerate or stop the putter head at or near impact, which results in an incomplete swing. By providing an object (in this case the hosel 28) between the line of sight of the golfer and the ball, it is believed that the optic nerve reaction will be significantly reduced or eliminated. Thus, the arrangement of the hosel 28 between the golfer's eyes and the ball reduces deceleration through the impact area and produces a more effective, smoother swing. The fact that the shaft is aligned with the ball enhances this effect, because the golfer's eyes are directed down the shaft to the ball at the beginning of the swing and at impact, which promotes constant eye contact with the ball during the swing, and precise contact between the sweet spot for the club and the ball.

By moving the projection of the longitudinal axis 16 of the shaft 14 outward beyond the center of gravity of the putter head 12 (line 60, FIGS. 3 and 4), the putter 10 introduces a linear approach to the putting stroke. Prior art putters, by having the shaft point at the center of the club face or behind the club face, promote an open and closed, arcing putting stroke in which the goal is to hit the ball when the club face is "square," or perpendicular to the target line. As can be understood, very often the golf ball would be struck in these prior art methods with the club face not completely squared at impact, causing the golf ball to go off-line or to spin to the left or right upon impact. By removing the projection of the longitudinal axis 16 of the shaft 14 out beyond the center of the club face 24, the tendency to move the club face in this arc pattern is removed. Instead, the natural movement of the hands and the putter 10 are along a line, with the club face 24 remaining perpendicular to the target at all points along the putting stroke. In this manner, the design of the putter 10 improves the possibility that the putter head will be square with the golf ball 66 upon impact.

Many golfers believe that it is ideal to have the eyes directly above the putter, or not too far behind the putter during a putting stroke. By providing the projection of the longitudinal axis 16 beyond the center of the club face 24, the end of the golf shaft 14 is moved outward further away from the body, moving the putter head 12 toward a position below the eyes of the golfer. This feature permits the golfer to place hands on the grip of the shaft 14 in a manner which closely resembles the golf grip for shorter irons in a golf set. Thus, if an amateur were to use the putter 10, that amateur would not have to use a different grip for irons of a golf set and the putter. In addition, the angle of the arms of the golfer made with the shaft is less drastic, and therefore more comfortable, thus relaxing the golfer and promoting free swinging of the putter during a stroke.

Moving the tip of the putter shaft 14 away from the body of a golfer also permits the golfer to more easily set the hands in a position just forward of the club face at take-away. This permits the golfer to reduce wrist breakdown or collapse during the golf swing by properly setting the angle of the golfer's wrist relative to the golf shaft before the swing so that angle can be maintained during the swing.

While the preferred embodiment of the invention has been illustrated and described with reference to preferred embodiments thereof, it will be appreciated that various changes can be made therein without departing from the spirit and scope of the invention as defined in the appended claims.

The embodiments of the invention in which an exclusive property or privilege is claimed are defined as follows:

1. A golf club comprising:

a putter head having a face, a toe and a heel;

an elongated shaft having a longitudinal axis and a lower end; and a hosel attaching the putter head to the elongate shaft;

a cantilevered extension extending between the heel of the putter head and the hosel; and wherein the cantilevered extension extends upward and forward from the heel toward the toe of the putter head so as to extend over the putter head.

2. The golf club of claim 1, wherein the cantilevered extension extends beyond a vertical projection of the center of the face of the putter head.

3. The golf club of claim 1, wherein the putter head further comprises a toe mass concentration and a heel mass concentration.

4. The golf club of claim 3 further comprising a mass concentration located at the distal end of the cantilevered extension.

5. The golf club of claim 1, wherein the golf club is balanced in weight relative to a projection of the longitudinal axis of the shaft.

6. The golf club of claim 5, wherein the putter head is balanced in weight on opposite sides of a vertical projection extending upward from the center of gravity of the putter.

7. A golf club comprising:

a putter head having a face, a toe and a heel;

an elongated shaft having a longitudinal axis and a lower end, the lower end of the shaft being attached to the putter at a hosel;

a cantilevered extension extending between the heel of the putter head and the hosel; and wherein the cantilevered extension extends upward and forward from the heel toward the toe of the putter head so as to extend over the putter head.

8. The golf club of claim 7, wherein the cantilevered extension extends beyond a vertical projection of the center of the face of the putter head.

9. The golf club of claim 7, wherein the putter head further comprises a toe mass concentration and a heel mass concentration.

10. The golf club of claim 7 further comprising a mass concentration located at the distal end of the cantilevered extension.

11. The golf club of claim 7, wherein the golf club is balanced in weight relative to a projection of the longitudinal axis of the shaft.

12. The golf club of claim 11, wherein the putter head is balanced in weight on opposite sides of a vertical projection extending upward from the center of gravity of the putter.

13. A golf club putter comprising:

a head having a face, a toe and a heel;

an elongated shaft having a longitudinal axis and a lower end; and a hosel attaching the head to the elongate shaft; and a cantilevered extension extending between the heel of the head and the hosel;

wherein the cantilevered extension extends upward and forward from the heel toward the toe of the head so as to extend over the head.

14. The golf club putter of claim 13, wherein the cantilevered extension extends beyond a vertical projection of the center of the face of the putter head.

15. The golf club putter of claim 13, wherein the head further comprises a toe mass concentration and a heel mass concentration.

16. The golf club of claim 13 further comprising a mass concentration located at the distal end of the cantilevered extension.

17. The golf club putter of claim 13, wherein the golf club putter is balanced in weight relative to a projection of the longitudinal axis of the shaft.

18. The golf club putter of claim 17, wherein the putter head is balanced in weight on opposite sides of a vertical projection extending upward from the center of gravity of the putter.

* * * * *